US008029066B2

(12) United States Patent
Su

(10) Patent No.: US 8,029,066 B2
(45) Date of Patent: Oct. 4, 2011

(54) BACKREST ASSEMBLY

(76) Inventor: Tung-Hua Su, Tainan Hsien (TW)

( * ) Notice: Subject to any disclaimer, the term of this patent is extended or adjusted under 35 U.S.C. 154(b) by 243 days.

(21) Appl. No.: 12/568,668

(22) Filed: Sep. 28, 2009

(65) Prior Publication Data

US 2011/0074202 A1 Mar. 31, 2011

(51) Int. Cl.
*A47C 7/02* (2006.01)

(52) U.S. Cl. ..... 297/452.18; 297/452.56; 297/440.11; 297/452.63

(58) Field of Classification Search ..... 297/440.11, 297/452.56, 452.55, 452.63, 452.18
See application file for complete search history.

(56) References Cited

U.S. PATENT DOCUMENTS 4,726,447 A * 2/1988 Gibson et al. ..... 182/135
5,168,615 A * 12/1992 Koa ..... 29/91.1
5,681,083 A * 10/1997 Nelson et al. ..... 297/284.1
6,036,272 A * 3/2000 Samples et al. ..... 297/452.55
6,378,944 B1 * 4/2002 Weisser ..... 297/440.11
6,550,866 B1 * 4/2003 Su ..... 297/452.42
6,966,606 B2 * 11/2005 Coffield ..... 297/452.56
7,066,550 B1 * 6/2006 Su ..... 297/440.22
7,152,929 B2 * 12/2006 Wu ..... 297/452.56
7,425,039 B2 * 9/2008 Lin ..... 297/452.56
7,434,888 B2 * 10/2008 Lin ..... 297/452.56
2008/0157580 A1 * 7/2008 Lin ..... 297/391
2008/0284229 A1 * 11/2008 Masunaga et al. ..... 297/452.18

* cited by examiner

*Primary Examiner* — David Dunn
*Assistant Examiner* — Erika Garrett

(57) ABSTRACT

A backrest assembly includes an annular front frame having a front surface on which inner and outer annular flanges are formed, defining a first annular groove therebetween. A plurality of pegs is formed in the annular groove. A net is mounted in front of the front frame in a tightened state and includes a plurality of peg holes. A periphery of the net covers the outer annular flange of the front frame and is received in the first annular groove. Each peg of the front frame extends through one of the peg holes. Inner and annular wall are formed on a front face of an annular rear frame and define a second annular groove therebetween. A plurality of stubs is formed in the second annular groove. Each stub includes a receptacle receiving one of the pegs. Fasteners are extended through engaging holes in the front and rear frames.

6 Claims, 9 Drawing Sheets

A-A

B-B

BACKREST ASSEMBLY

BACKGROUND OF THE INVENTION

1. Field of the Invention

The present invention relates to a backrest assembly and, more particularly, to a back assembly that is reliable, durable, and easy to assemble.

2. Description of the Related Art

A backrest of a chair provides a support for a back of a user sitting in the chair. For venting purposes, the backrest is provided with a net. FIGS. 8 and 9 show a conventional backrest with a net. Specifically, the backrest includes an annular frame 1' made of rigid material and having a plurality of fixing holes 11'. A flexible net 2' is fixed by nails 3' to an engaging portion 12' on a front side of the frame 1' to tighten the net 2'. A cover 4' having a shape corresponding to the frame 1' is mounted to the front side of the frame 1'. The cover 4' includes a plurality of coupling holes 41' aligned with the fixing holes 11'. Screws 5' are extended through the fixing holes 11' and the coupling holes 41' to fix the cover 4' and the frame 1' together while providing a quality appearance from a front side of the backrest.

However, when a user lies against the backrest, the lying force is imparted to the nails 3'. Some of the nails 3' are liable to loose when the lying force is large or not applied to a center of the backrest. Furthermore, the net 2' can not be maintained in its tightened state. Further, the fixing holes 11' and the screws 5' can be viewed from the rear side of the backrest, adversely affecting the appearance. Further, recycling of the backrest is not easy due to difficulties in removing the nails 3' before separating the net 2' from the frame 1'.

BRIEF SUMMARY OF THE INVENTION

An objective of the present invention is to provide a backrest assembly that is reliable and durable.

Another objective of the present invention is to provide a backrest assembly that is more aesthetic in appearance.

A further objective of the present invention is to provide a backrest assembly that is easy to recycle.

The present invention fulfills the above objectives by providing, in a preferred form, a backrest assembly including an annular front frame made of rigid material and having front and rear surfaces spaced in a first direction. An outer annular flange is formed on the rear surface. An inner annular flange is formed on the rear surface and surrounded by the outer annular flange, defining a first annular groove between the outer and inner annular flanges. A plurality of annularly spaced pegs is formed on the rear surface and in the annular groove. The front frame further includes a plurality of first engaging holes extending in a second direction perpendicular to the first direction. A net is made of bendable material and includes a plurality of peg holes. The net is mounted in front of the front frame and in a tightened state. A periphery of the net covers the outer annular flange of the front frame and is received in the first annular groove of the front frame. Each of the plurality of pegs of the front frame extends through one of the plurality of peg holes. An annular rear frame made of rigid material includes front and rear faces spaced in the first direction. An outer annular wall is formed on the front face of the rear frame. An inner annular wall is formed on the front face of the rear frame and surrounded by the outer annular wall, defining a second annular groove between the outer and inner annular walls. A plurality of annularly spaced stubs is formed on the front face of the rear frame and in the second annular groove. Each of the plurality of stubs includes a receptacle receiving one of the plurality of pegs of the front frame. The rear frame further includes a plurality of second engaging holes extending in the second direction. A fastener is extended through each first engaging hole of the front frame and one of the second engaging holes of the rear frame.

In a preferred form, the net includes a tear-resistant coupling member fixed to the periphery thereof. The coupling member includes the plurality of peg holes and is received in the first annular groove. In another preferred form, a portion of the net is fixed by nails to the front frame.

In preferred forms, with the plurality of first engaging holes is formed in the inner annular flange of the front frame, and the plurality of second engaging holes is formed in the inner annular wall of the rear frame and aligned with the plurality of first engaging holes. An end face of each of the plurality of stubs presses against a circumference of one of the plurality of peg holes of the net. The rear frame further includes an outer annular abutting section intermediate the outer annular wall and each of the plurality of stubs in the second direction and intermediate the front face of the rear frame and the end face of the outer annular wall of the rear frame in the second direction. The periphery of the net is sandwiched between the outer annular abutting section of the rear frame and the outer annular flange of the front frame. Furthermore, the rear frame includes an inner annular abutting section surrounded by the outer annular abutting section. The inner annular wall is intermediate the inner annular abutting section in the second direction and each of the plurality of stubs and intermediate the end face of the stub and the inner annular abutting section in the first direction. The inner annular flange of the front frame abuts the inner annular abutting section of the rear frame.

The present invention will become clearer in light of the following detailed description of an illustrative embodiment of this invention described in connection with the drawings.

Figure 1:
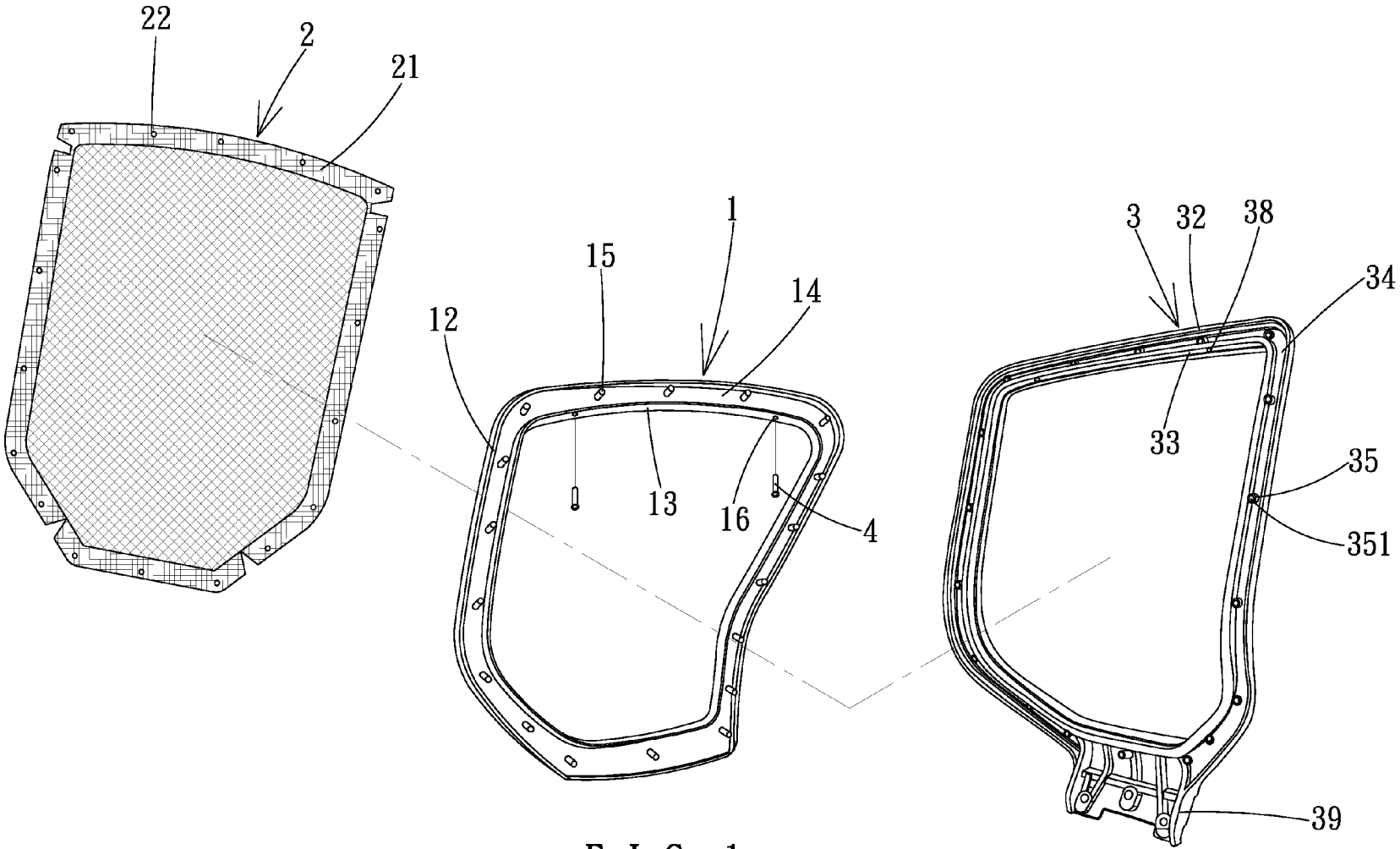
FIG. 1 shows an exploded, perspective view of a backrest assembly of an embodiment according to the preferred teachings of the present invention.
Figure 2:
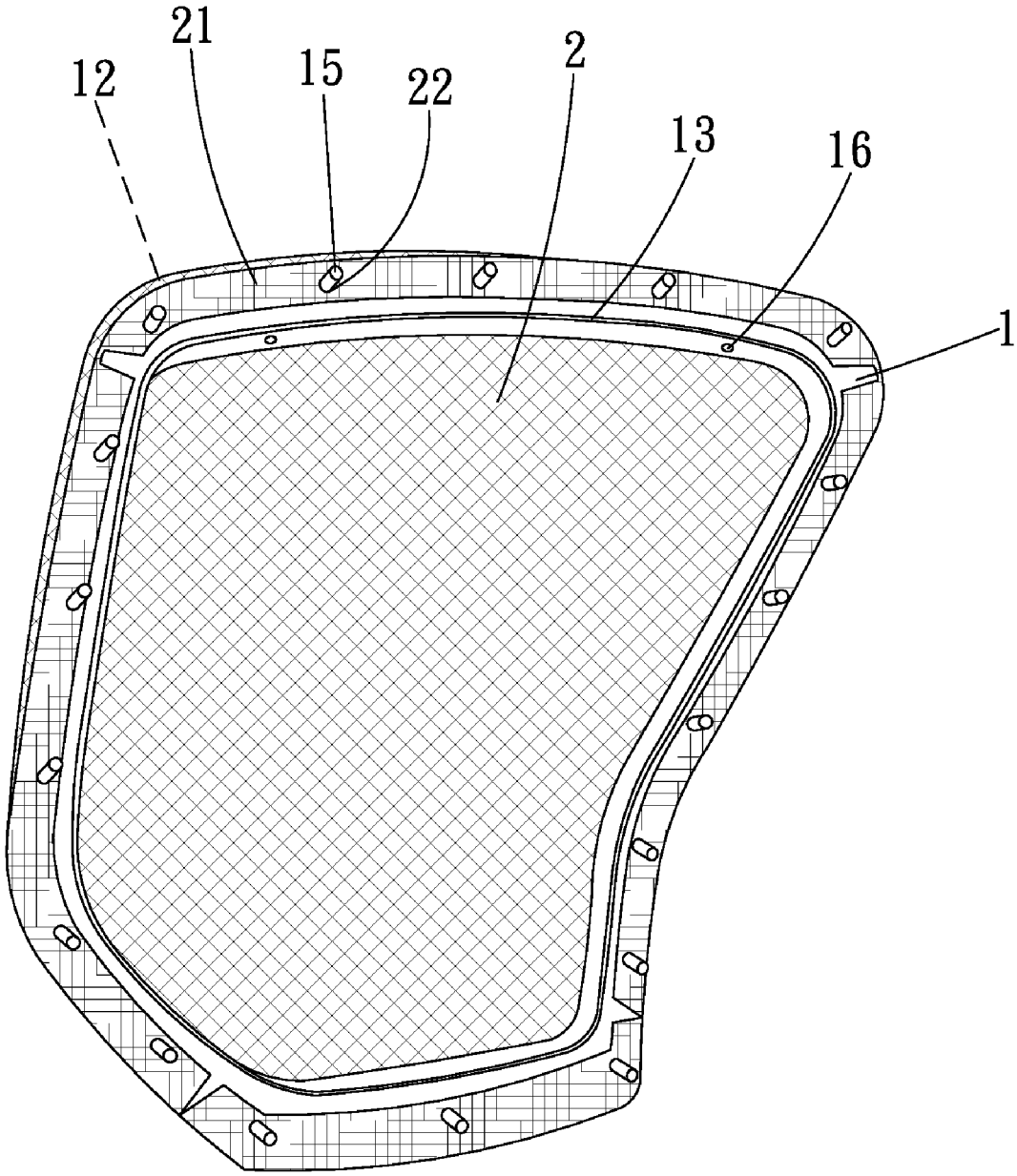
FIG. 2 shows a perspective view of a front frame and a net of the backrest assembly of FIG. 1 after assembly.
Figure 3:
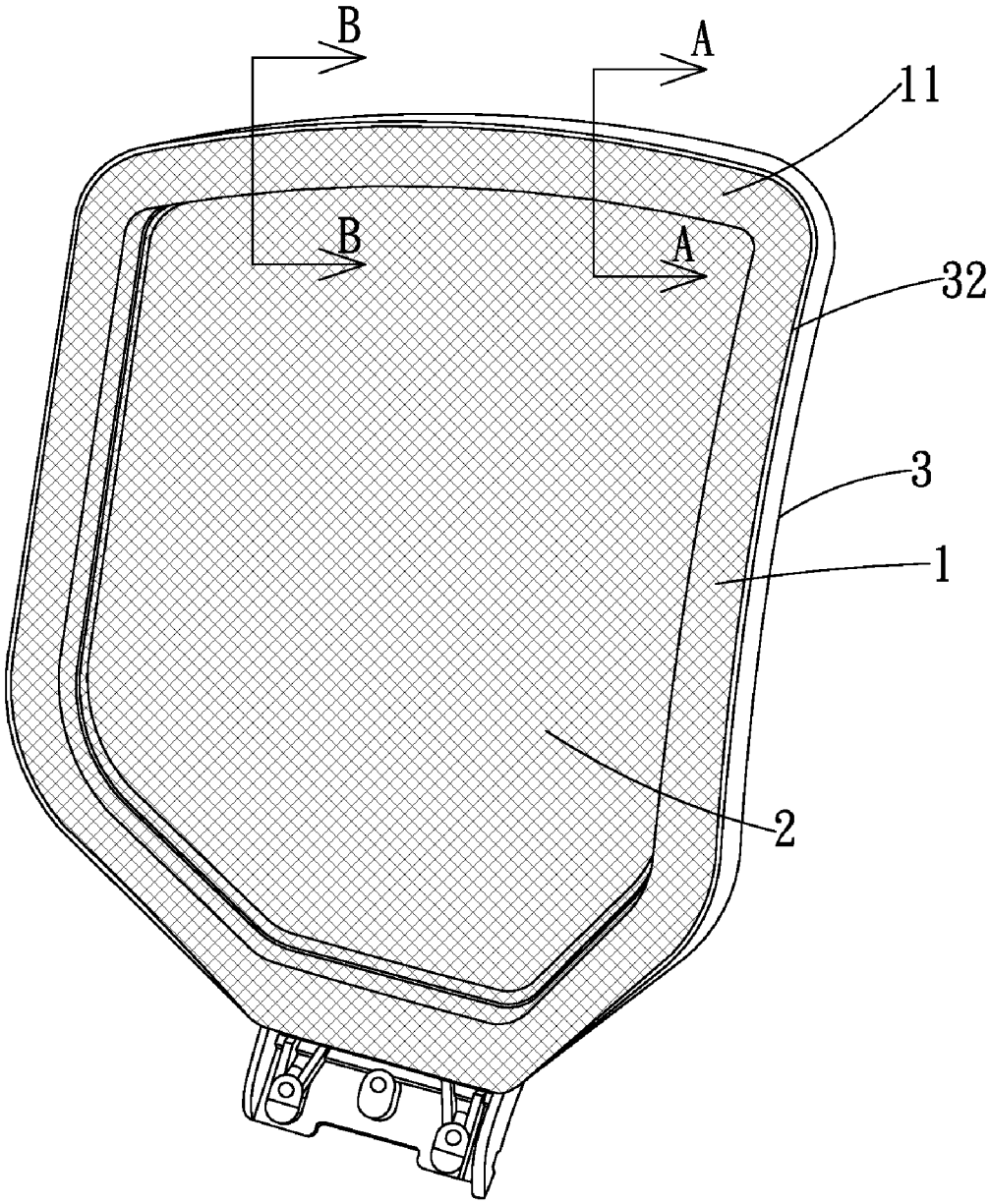
FIG. 3 shows a front, perspective view of the backrest assembly of FIG. 1.
Figure 4:
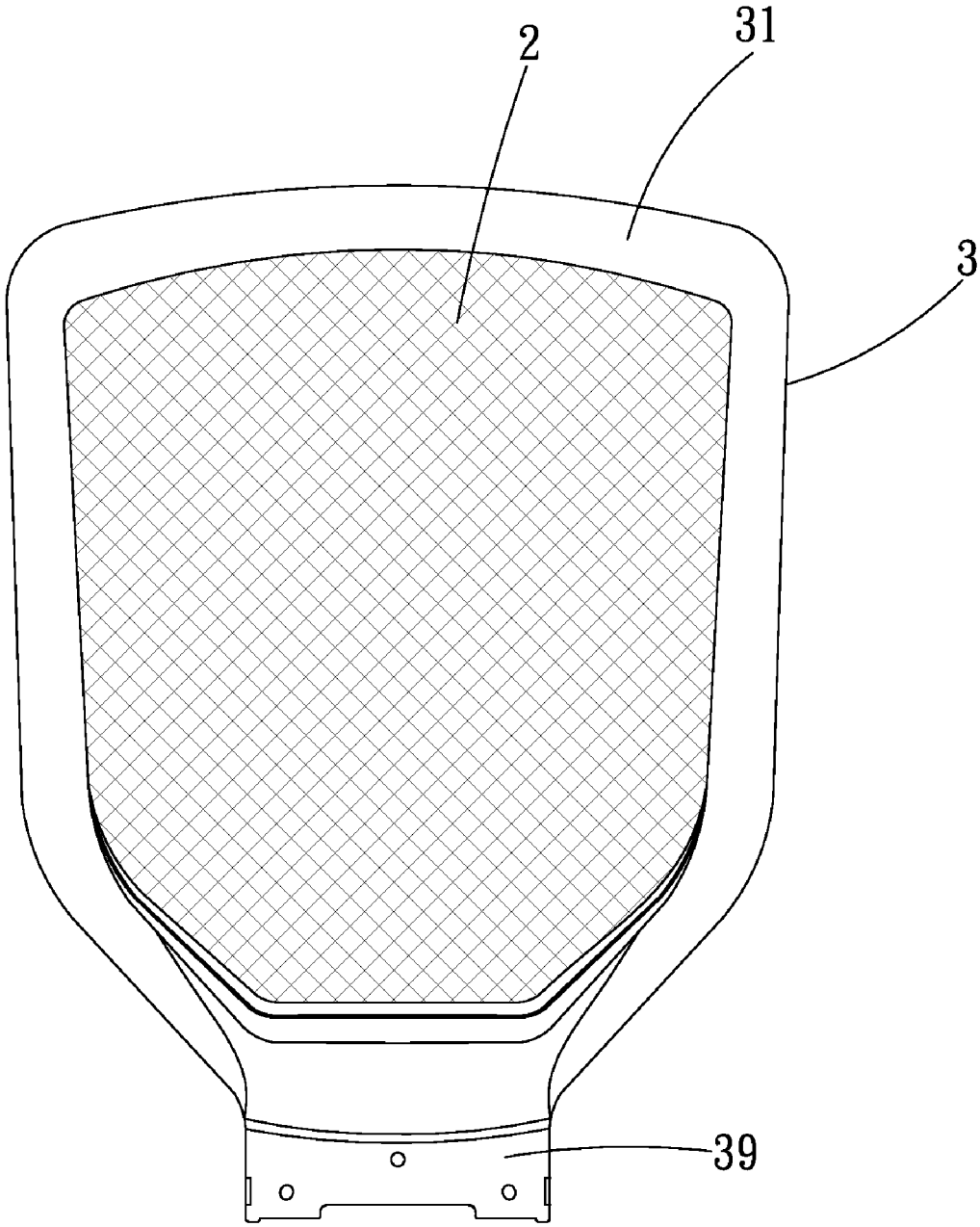
FIG. 4 shows a rear, perspective view of the backrest assembly of FIG. 1.
Figure 5:
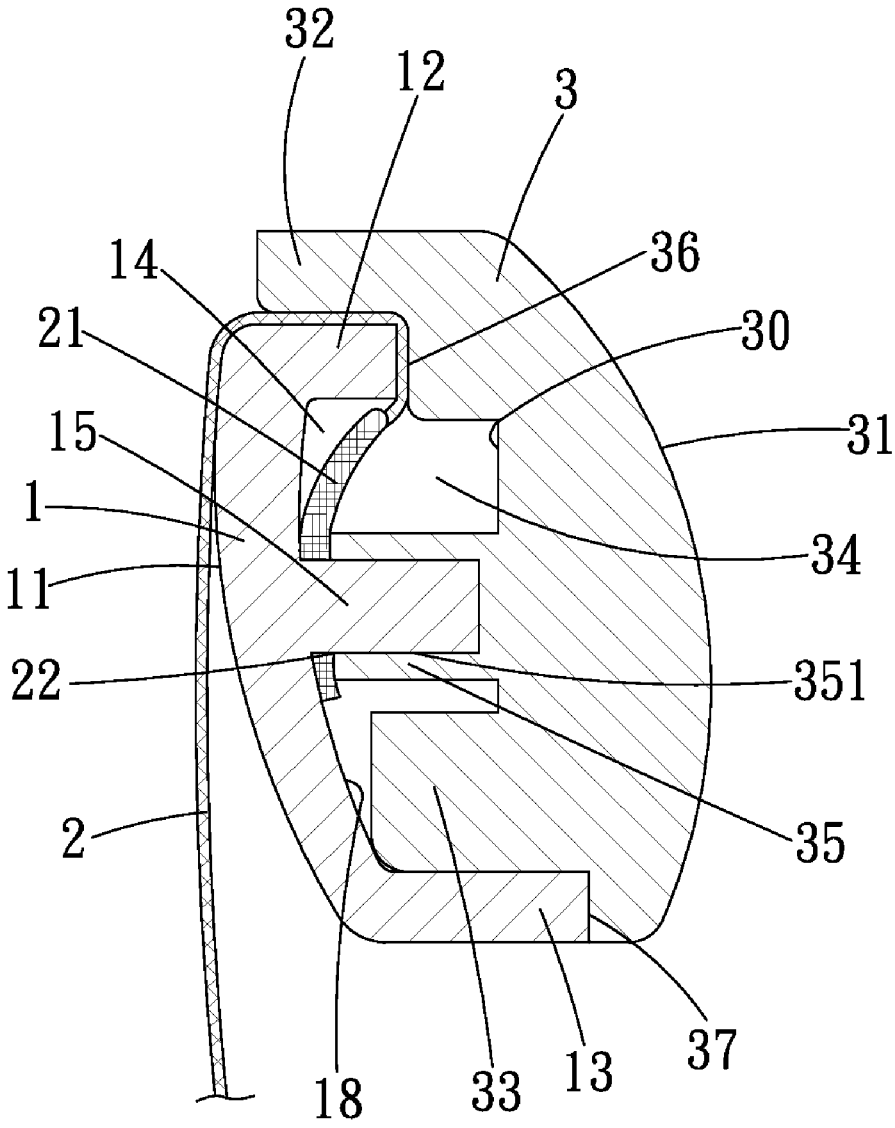
FIG. 5 shows a partial, cross sectional view of the backrest assembly of FIG. 1 according to section line A-A of FIG. 3.
Figure 6:
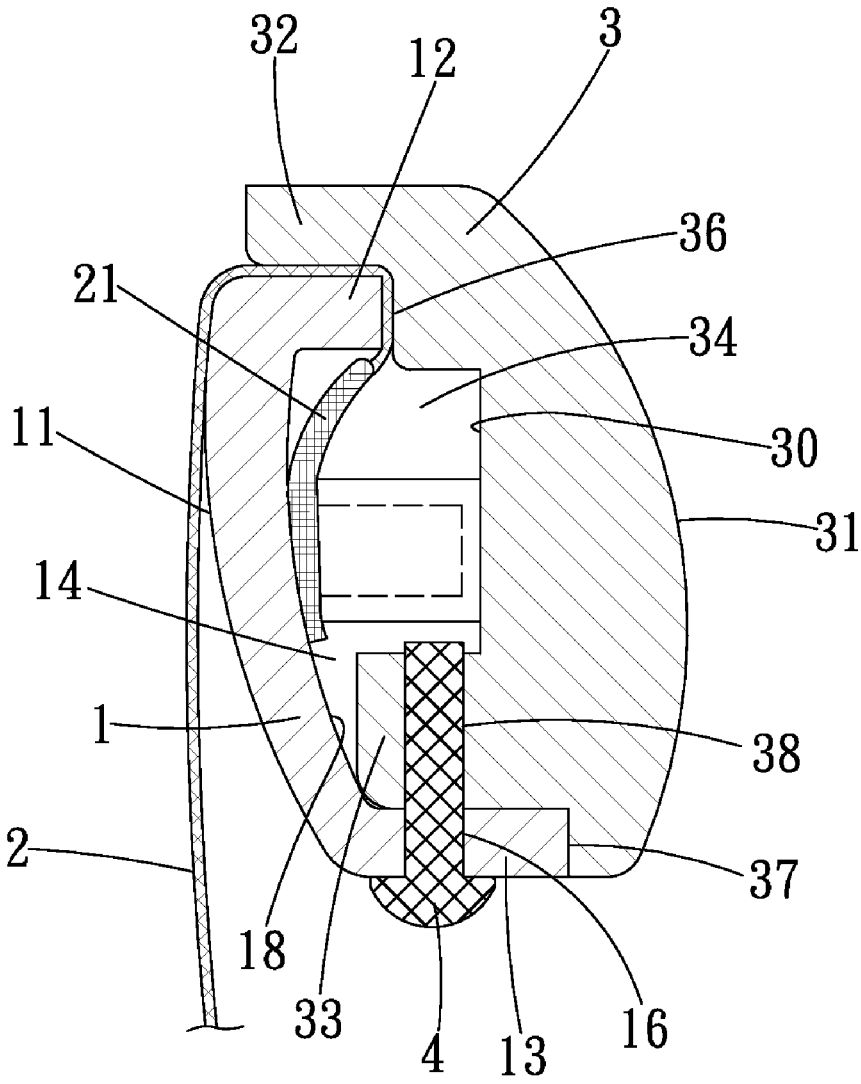
FIG. 6 shows a partial, cross sectional view of the backrest assembly of FIG. 1 according to section line B-B of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

A backrest assembly of a first embodiment according to the preferred teachings of the present invention FIGS. 1-6 and generally includes a front frame 1, a net 2, a rear frame 3, and a plurality of fasteners 4. The front frame 1 is annular and made of rigid material and includes front and rear surfaces 11 and 18 spaced in a first direction. An outer annular flange 12 is formed along a peripheral edge of the rear surface 18. Furthermore, an inner annular flange 13 is formed on the rear surface 18 and surrounded by the outer annular flange 12, defining an annular groove 14 between the outer and inner annular flanges 12 and 13. A plurality of annularly spaced pegs 15 is formed on the rear surface 18 and in the annular groove 14. The inner annular flange 13 includes a plurality of engaging holes 16 extending in a second direction perpendicular to the first direction.

The net 2 is made of bendable material and includes a coupling member 21 fixed to a periphery of the net 2 such as by sewing. The coupling member 21 is made of tear-resistant material and includes a plurality of peg holes 22. The net 2 is mounted in front of the front frame 1 with the periphery of the net 2 covering the outer annular flange 12 and with each peg 15 of the front frame 1 extending through one of the peg holes 22. The net 2 assembled to the front frame 1 is in a tightened state and covers the front surface 11 of the front frame 1. The coupling member 21 is received in the annular groove 14.

The rear frame 3 is annular and made of rigid material and includes front and rear faces 30 and 31 spaced in the first direction. An outer annular wall 32 is formed along a peripheral edge of the front face 30. Furthermore, an inner annular wall 33 is formed on the front face 30 and surrounded by the outer annular wall 32, defining an annular groove 34 between the outer and inner annular walls 32 and 33. A plurality of annularly spaced stubs 35 is formed on the front face 30 and in the annular groove 34. Each stub 35 includes a receptacle 351. The rear frame 3 further includes an outer annular abutting section 36 intermediate the outer annular wall 32 and each stub 35 in the second direction and intermediate the front face 30 and an end face of the outer annular wall 32 in the second direction. The rear frame 3 further includes an inner annular abutting section 37 surrounded by the outer annular abutting section 36. The inner annular wall 33 is intermediate the inner annular abutting section 37 and each stub 35 in the second direction and intermediate an end face of the stub 35 and the inner annular abutting section 37 in the first direction. The inner annular wall 33 includes a plurality of engaging holes 38 extending in the second direction. The rear frame 3 further includes a coupling section 39 adapted to be coupled to a seat or another component of a chair.

After mounting the net 2 to the front frame 1, each peg 15 of the front frame 1 is inserted into the receptacle 351 of one of the stubs 35 of the rear frame 3. Each fastener 4 is extended through one of the engaging holes 16 of the front frame 1 into one of the engaging holes 38 of the rear frame 3 aligned with the engaging hole 16, preventing the front frame 1 from disengaging from the rear frame 3. After assembly, the end face of each stub 35 press against a circumference of one of the peg holes 22 of the net 2. Furthermore, the periphery of the net 2 is reliably sandwiched between the outer annular flange 12 and the outer annular abutting section 36. Further, the inner annular flange 13 abuts the inner annular abutting section 37. The inner and outer annular abutting sections 37 and 36 provide the backrest assembly according to the teachings of the present invention with assembly integrity. Since the engaging holes 16 and 38 can not be seen from either of the front and rear sides of the backrest assembly and since the rear face 31 of the rear frame 3 is free of engaging holes, the backrest assembly according to the teachings of the present invention looks integral and aesthetic.

The net 2 is maintained in its tightened state even though the backrest assembly according to the preferred teachings of the present invention is subjected to a lying force from a user, because the net 2 is not movable after the pegs 15 of the front frame 1 extend through the peg holes 22 of the net 2. The assembly is, thus, stable and reliable. Furthermore, when the backrest assembly according to the teachings of the present invention is to be recycled after having been used for a period of time, the front and rear frames 1 and 3 can be separated from each other after removing the fasteners 4. Then, the net 2 can be removed from the pegs 15 by disengaging the peg holes 22 from the pegs 15, allowing easy recycling.

Figure 7:
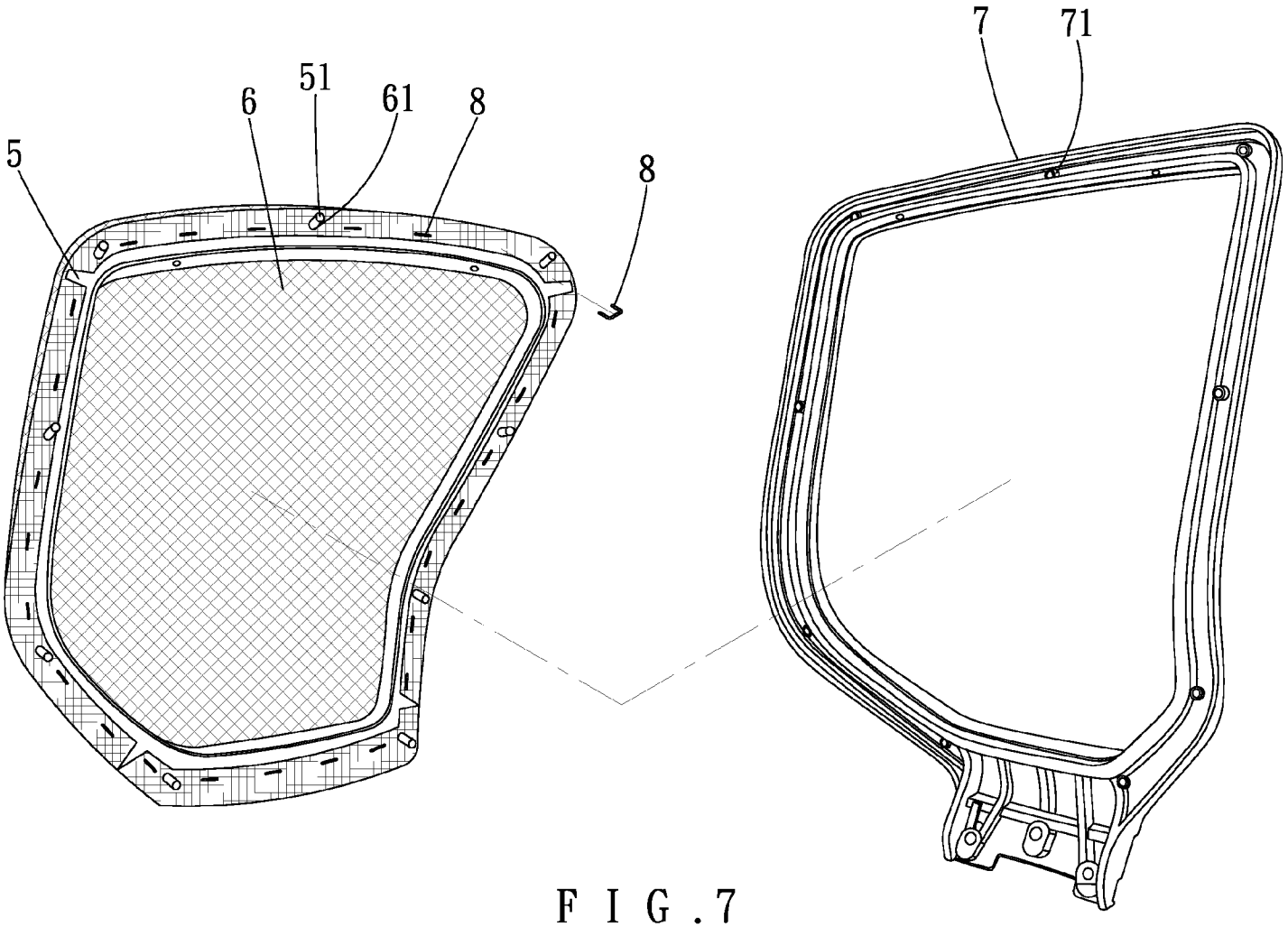
FIG. 7 shows an exploded, perspective view of a backrest assembly of another embodiment according to the preferred teachings of the present invention.
Figure 8:
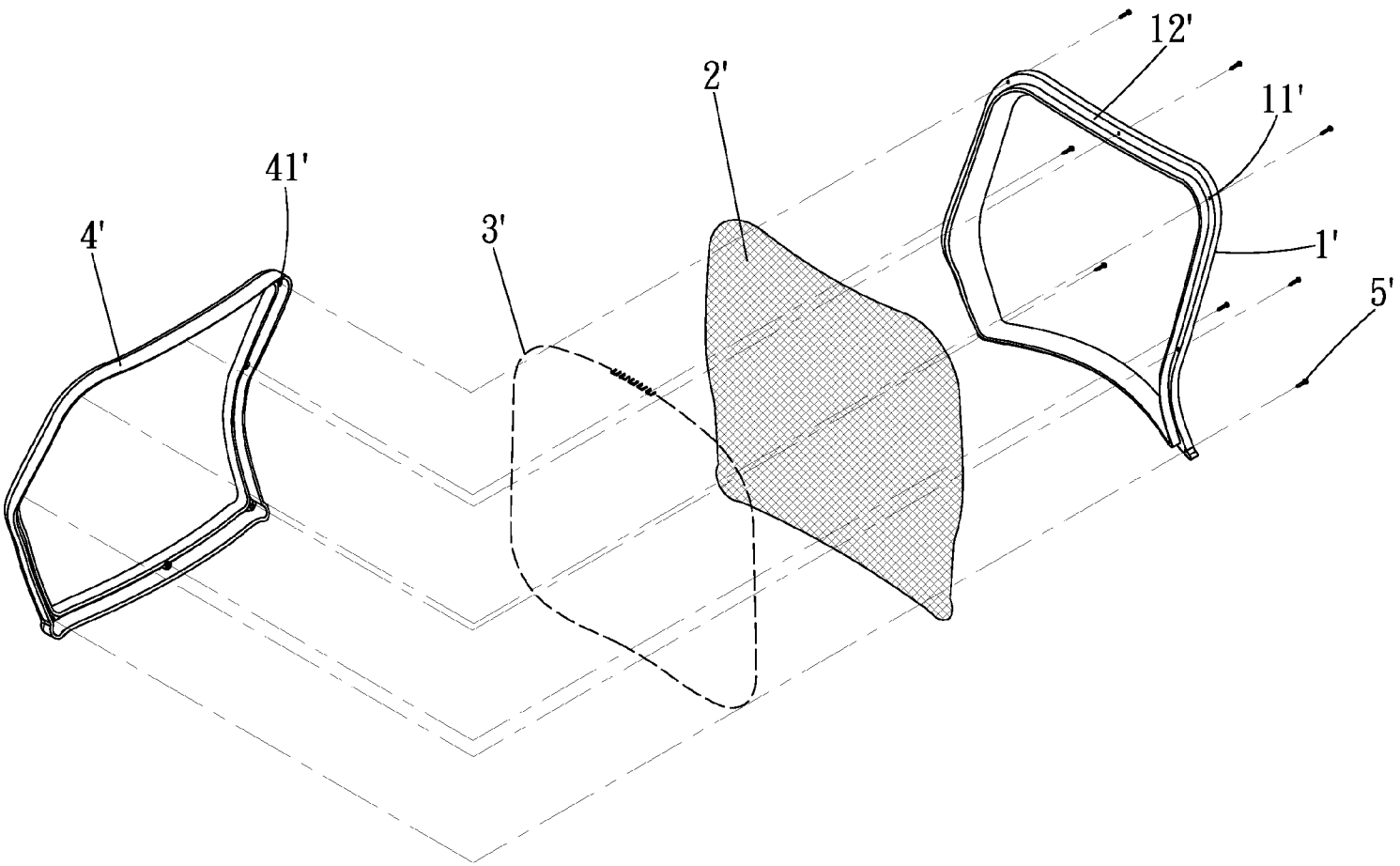
FIG. 8 shows an exploded, perspective view of a conventional backrest.
Figure 9:
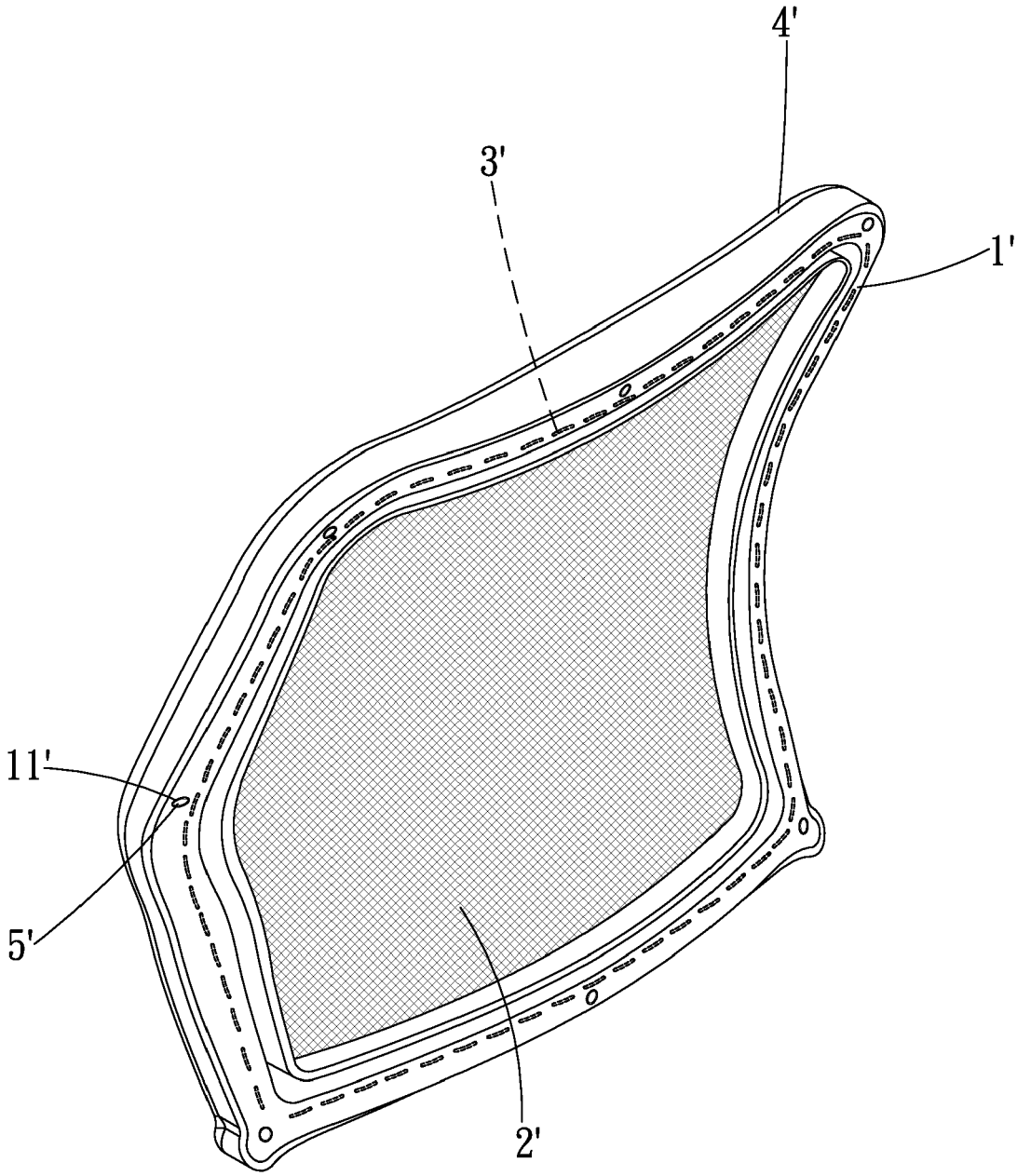
FIG. 9 shows a perspective view of the backrest of FIG. 8.

FIG. 7 shows a backrest assembly of a second embodiment according to the preferred teachings of the present invention. In this embodiment, the spacing between the pegs (now designated by 51) of the front frame (now designated by 5) and the spacing between the stubs (now designated by 71) of the rear frame (now designated by 7) are larger. The pegs 51 of the front frame 5 are extended through the peg holes (now designated by 61) of the net (now designated by 6) to maintain the net 6 in the tightened state. Furthermore, a portion of the net 6 are fixed by nails 8 to the front frame 5. Thus, even the backrest assembly is subjected to the lying force from the user, the nails 8 will not become loose, providing stable, reliably assembly.

It can be appreciated that the net can be made of tear-resistant material, so that the net does not have to include the coupling member having the peg holes. Instead, the peg holes can be directly formed in the net.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A backrest assembly comprising:

a front frame made of rigid material, with the front frame being annular and including front and rear surfaces spaced in a first direction, with an outer annular flange formed on the rear surface, with an inner annular flange formed on the rear surface and surrounded by the outer annular flange, defining a first annular groove between the outer and inner annular flanges, with a plurality of annularly spaced pegs formed on the rear surface and in the annular groove, with the front frame further including a plurality of first engaging holes extending in a second direction perpendicular to the first direction;

a net made of bendable material and including a plurality of peg holes, with the net mounted in front of the front frame, with a periphery of the net covering the outer annular flange of the front frame and received in the first annular groove of the front frame, with each of the plurality of pegs of the front frame extending through one of the plurality of peg holes, with the net in a tightened state;

a rear frame made of rigid material, with the rear frame being annular and including front and rear faces spaced in the first direction, with an outer annular wall formed on the front face of the rear frame, with an inner annular wall formed on the front face of the rear frame and surrounded by the outer annular wall, defining a second annular groove between the outer and inner annular walls, with a plurality of annularly spaced stubs formed on the front face of the rear frame and in the second annular groove, with each of the plurality of stubs including a receptacle receiving one of the plurality of pegs of the front frame, with the rear frame further including a plurality of second engaging holes extending in the second direction; and a plurality of fasteners each extending through one of the plurality of first engaging holes of the front frame and one of the plurality of second engaging holes of the rear frame.

2. The backrest assembly as claimed in claim 1, with the net including a coupling member fixed to the periphery thereof, with the coupling member made of tear-resistant material and including the plurality of peg holes, and with the coupling member received in the first annular groove.

3. The backrest assembly as claimed in claim 1, with the plurality of first engaging holes formed in the inner annular flange of the front frame, and with the plurality of second engaging holes formed in the inner annular wall of the rear frame and aligned with the plurality of first engaging holes.

4. The backrest assembly as claimed in claim 1, with an end face of each of the plurality of stubs pressing against a circumference of one of the plurality of peg holes of the net, with the rear frame further including an outer annular abutting section intermediate the outer annular wall and each of the plurality of stubs in the second direction and intermediate the front face of the rear frame and the end face of the outer annular wall of the rear frame in the second direction, and with the periphery of the net sandwiched between the outer annular abutting section of the rear frame and the outer annular flange of the front frame.

5. The backrest assembly as claimed in claim 4, with the rear frame further including an inner annular abutting section surrounded by the outer annular abutting section, with the inner annular wall being intermediate the inner annular abutting section in the second direction and each of the plurality of stubs and intermediate the end face of the stub and the inner annular abutting section in the first direction, and with the inner annular flange of the front frame abutting the inner annular abutting section of the rear frame.

6. The backrest assembly as claimed in claim 1, with a portion of the net fixed by nails to the front frame.

* * * * *